US007746007B2

(12) United States Patent
Cauffield

(10) Patent No.: US 7,746,007 B2
(45) Date of Patent: Jun. 29, 2010

(54) LED BACKLIGHT CIRCUIT SYSTEM

(75) Inventor: Robert Cauffield, Lawrenceville, GA (US)

(73) Assignee: American Panel Corporation, Inc., Alpharetta, GA (US)

( * ) Notice: Subject to any disclaimer, the term of this patent is extended or adjusted under 35 U.S.C. 154(b) by 311 days.

(21) Appl. No.: 11/944,939

(22) Filed: Nov. 26, 2007

(65) Prior Publication Data

US 2009/0134806 A1 May 28, 2009

(51) Int. Cl.
*H05B 37/02* (2006.01)
*G09G 3/36* (2006.01)

(52) U.S. Cl. ..... 315/307; 315/312; 345/102

(58) Field of Classification Search ..... 315/185 R, 315/186, 209 R, 210, 291, 307, 312; 345/102; 362/600, 612, 613, 227, 800
See application file for complete search history.

(56) References Cited

U.S. PATENT DOCUMENTS 6,521,879 B1 * 2/2003 Rand et al. ..... 250/205
6,529,182 B1 3/2003 Burton
6,621,235 B2 * 9/2003 Chang ..... 315/216
6,812,916 B2 11/2004 Hwang
6,822,403 B2 * 11/2004 Horiuchi et al. ..... 315/307
6,864,867 B2 * 3/2005 Biebl ..... 345/82
6,949,892 B2 * 9/2005 Horiuchi et al. ..... 315/308
6,969,189 B2 11/2005 Lee et al.
7,157,859 B2 * 1/2007 Inoue ..... 315/185 R
7,239,087 B2 * 7/2007 Ball ..... 315/128
7,518,319 B2 * 4/2009 Konno et al. ..... 315/291
7,521,879 B2 * 4/2009 Hong et al. ..... 315/307
2005/0073495 A1 4/2005 Harbers et al.
2005/0243022 A1 * 11/2005 Negru ..... 345/46
2007/0013647 A1 1/2007 Lee et al.
2007/0159750 A1 * 7/2007 Peker et al. ..... 361/93.1
2007/0215854 A1 * 9/2007 Chou et al. ..... 257/13
2007/0262724 A1 * 11/2007 Mednik et al. ..... 315/125
2008/0001547 A1 * 1/2008 Negru ..... 315/189
2009/0179575 A1 * 7/2009 Mednik et al. ..... 315/193

* cited by examiner

*Primary Examiner*—Thuy Vinh Tran
(74) *Attorney, Agent, or Firm*—Stanley Law Group LLP

(57) ABSTRACT

An improved electrical circuit design and method to drive a plurality of LEDs in an LCD backlight in order to produce a uniform color distribution across the entire viewable surface of the display. The embodiments disclosed have features that permit a predetermined reduction in the amount of current provided to the LEDs positioned along the edge of the display region. This results in color uniformity, and consequently, an improved picture quality.

16 Claims, 6 Drawing Sheets

LED BACKLIGHT CIRCUIT SYSTEM

CROSS-REFERENCE TO RELATED APPLICATIONS

This application is a non-provisional patent application and claims no priority.

TECHNICAL FIELD

An exemplary embodiment relates in general to light emitting diode (LED) control circuits, and more particularly, to an electrical circuit that can solve the problems, which may be caused by the arrangement of such LEDs in an LED backlight panel.

BACKGROUND OF THE ART

Liquid Crystal Displays (LCDs) often incorporate backlight panels to permit viewing in poor lighting conditions. A cold cathode fluorescent lamp (CCFL) is widely used as a light source of a conventional backlight for an LCD. Since the CCFL uses mercury gas, it may cause environmental pollution. Furthermore, the CCFL has a relatively slow response time and a relatively low color reproduction. In addition, the CCFL is not proper to reduce the weight, thickness, and overall volume of an LCD panel to which it is applied.

The use of LEDs (Light Emitting Diodes) is also known for the purpose of illuminating such LCD displays. LEDs are eco-oriented and have a response time of several nanoseconds, thereby being effective for a video signal stream and enabling impulsive driving. Furthermore, the LEDs have 100% color reproduction and can properly vary luminance and color temperature by adjusting a quantity of light emitted from red, green and blue LEDs. In addition, the LEDs are proper to reduce the weight, thickness and overall volume of the LCD panel. Therefore, in recent years, they have been widely used as a light source of a backlight unit for the LCD.

The LCD backlight employing the LEDs can be classified into an edge type backlight and a direct type backlight according to positions of the light source. In the edge type backlight, the light source is positioned at a side and emits light toward a front surface of the LCD panel using a light guide plate. In the direct type backlight, the light source is a surface light source placed under the LCD panel and having a surface area almost identical to that of the LCD panel and directly emits light toward the front surface of the LCD panel.

For direct type LED backlighting of LCD displays, it is desirable to use color (red, green, blue) LEDs to achieve the best color presentation through the LCD glass. The high brightness color LEDs are arranged in a pattern behind the LCD glass, and for many applications the surface area available for LEDs is no larger than the area of the LCD glass. This results in a pattern that will be non uniform along the edges of the LCD. For example, the top edge of this pattern may have too much red and green light, and the bottom edge of the pattern may have too much blue light.

There is an unmet need in the art for a system that produces color uniformity along the edges of LED or OLED displays.

SUMMARY

It is possible to attenuate the bright LED regions with mechanical transmission filters. However, an exemplary embodiment of the present invention solves the problem of color uniformity with an innovative electrical circuit. Accordingly, at least one embodiment is directed to a surface light source that substantially obviates one or more problems due to limitations and disadvantages of the related art.

At least one embodiment is an electrical circuit that will drive a plurality of LEDs to produce a uniform color distribution across the entire viewable surface of an LCD display.

To achieve these advantages and in accordance with exemplary embodiments of the invention, there is provided an electrical circuit design with features that permit a reduction in the amount of current flowing to the LEDs positioned along the edge of the display region. In at least one embodiment, the LEDs are arranged in series configuration, divided between the "center LEDs" and the "edge LEDs". At the electrical node between the center and edge LEDs a shunt tap is adapted to divert a portion of the total current away from the edge LEDs, thereby attenuating the light emitted from the edge positioned LEDs. This results in an improved picture quality.

Also disclosed are exemplary methods for achieving color uniformity in an LCD display with an LED backlight. In at least one exemplary method a plurality of LEDs is arranged along an electrical circuit in series. The edge LEDs are then divided from the center LEDs by way of an electrical node. A predetermined amount of current is diverted away from the edge LEDs through a shunt tap placed at the node. This attenuates the light emitted by the edge LEDs.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings. It is to be understood that both the foregoing general description and the following detailed description of the at least one embodiment are exemplary and explanatory.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION OF EXEMPLARY EMBODIMENTS

Figure 1:
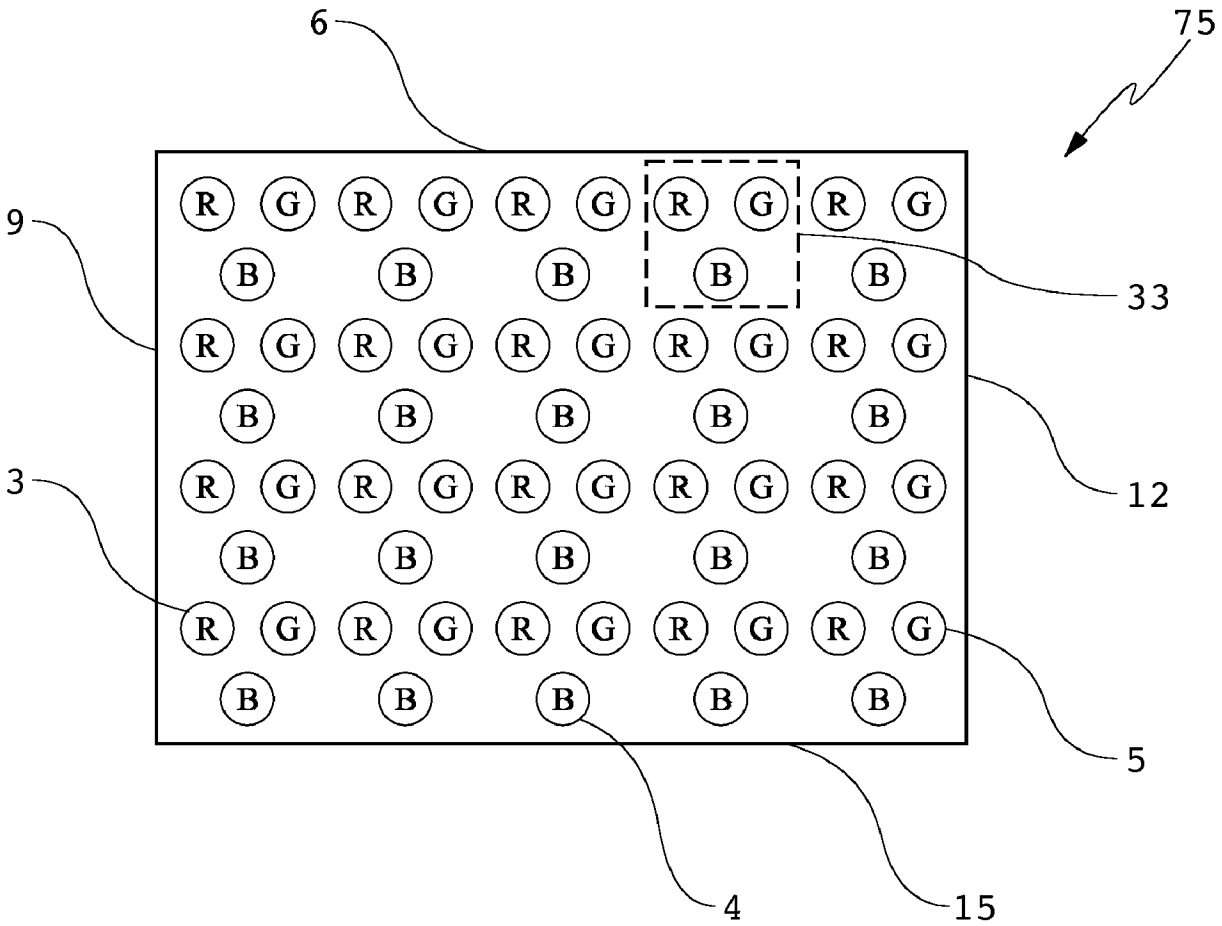
FIG. 1 is an explanatory schematic illustrating the color uniformity difficulties that arise when multi-color LEDs are used for backlighting an LCD display.

With reference to FIG. 1, a schematic showing one possible arrangement of multi-color LEDs in an LCD backlight for a display 75. The display area has discrete edges; a right edge 12, a bottom edge 15, a left edge 9 and a top edge 6. The color LEDs are placed in color groups 33 comprising Red (R) LEDs 3, Green (G) LEDs 5, and Blue (B) LEDs 4. More than 3 color varieties may be present for some LED backlights. As shown, each LED color group 33 may be uniformly arranged to provide backlighting for an electronic display 75. Display 75 represents a typical display area which generally is square or rectangular in shape. Other shapes are possible and the actual number of LEDs needed for the backlight will depend on the size of the display 75, the luminous flux of each LED, and the required brightness of the display.

As may be understood from FIG. 1, color uniformity issues arise when multi-color LEDs are arranged to provide the backlighting for an LCD screen. Although most of the LCD display will have a uniform mixture of Red, Green, and Blue light, the edge portions of the display will tend to emit an overabundance of the particular colored light from the specific LEDs that are concentrated along the given edge. As is apparent, color uniformity problems will occur no matter how the LEDs color groups 33 are arranged if the color groups are arranged uniformly. Furthermore, non-uniform arrangements of the LED color groups 33 will only shift the color uniformity issues toward the center of the display 75.

In the example shown if FIG. 1, the bottom edge 15 of the display 75 shown will tend to have an overabundance of blue light because there are more blue LEDs 4 located in that region. Similarly, the left edge 9 will appear overly red because of the position of the red LEDs 3. Likewise, the right edge 12 of the display will look overly Green because there is a concentration of green LEDs 5. Similar problems will exist at each of the display edges. The effect from these unevenly mixed regions of color LEDs is an undesirable picture quality.

Figure 2:
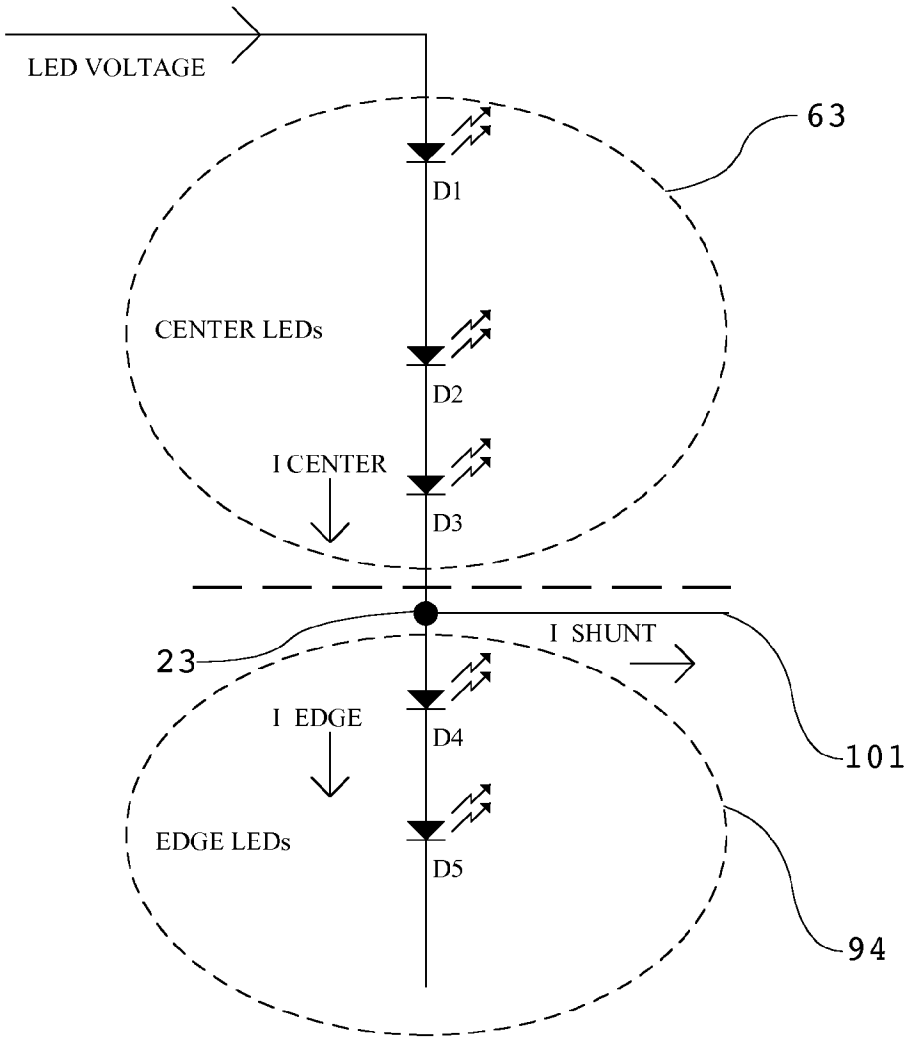
FIG. 2 shows an exemplary embodiment of an LED backlight shunting system.

FIG. 2 shows an exemplary LED active shunt current control system for controlling current flow through an LED backlight network. The schematic includes a plurality of LEDs arranged in series along a circuit (D1-D5). The LEDs at the edge position 94 ("edge LEDs") in the display are divided from center LEDs 63 in the display by an electrical node 23. The term "edge LEDs" refers to all those LEDs that line the peripheral edges of the display 75 (e.g., Red LED 3, Blue LED 4, and Green LED 5 in FIG. 1). The term "center LEDs" refers to all other LEDs making up the backlight panel. A shunt tap 101 is located at the electrical node 23 between the center LEDs 63 and the edge LEDs 94.

In operation, current passes through the center LEDs, "Icenter". However, before the current reaches the edge LEDs 94, the shunt tap 101 may divert a predetermined amount of that current, "I-shunt" away from the edge LEDs 94. Only the remaining current "ledge" is available to drive edge LEDs 94. In this arrangement, ledge may be determined by the equation: ledge=Icenter−Ishunt. In this way, the overabundance of colored light produced by edge LEDs may be attenuated to improve the picture quality. As may be appreciated by one of skill in the art, there are many possible ways to regulate the Ishunt value and thus determine the extent to which the edge LED light emission is attenuated.

Figure 3:
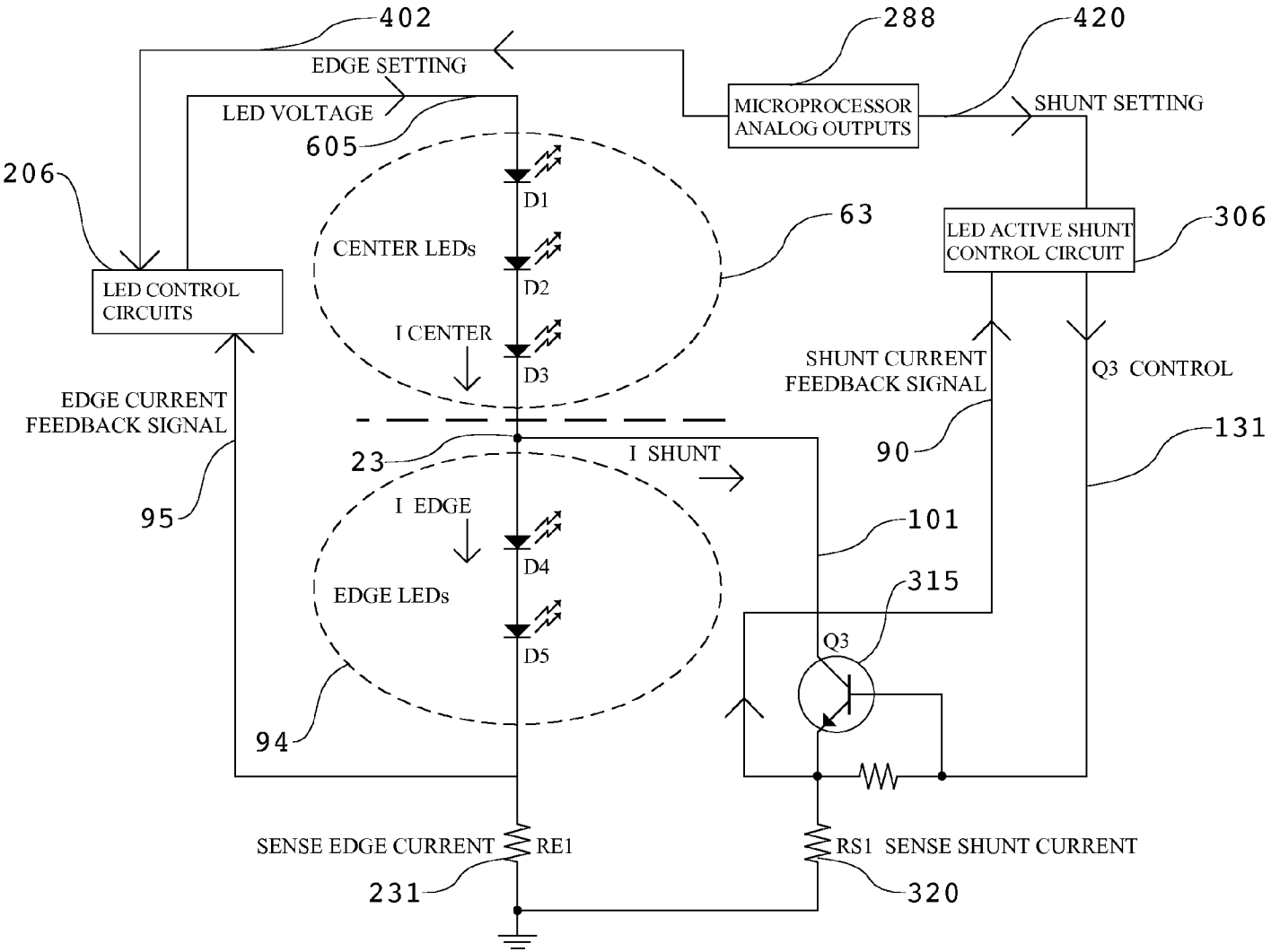
FIG. 3 is a circuit diagram illustrating an embodiment of the shunting process.

FIG. 3 shows one exemplary system that may be used to shunt current away from edge LEDs 94. In this embodiment, two analog inputs are provided by an analog output generator, microprocessor 288. The outputs comprise the shunt setting 420 and the edge setting 402. These voltages set the reference currents for the edge control circuit 206 and the shunt control circuit 306. In the embodiment shown, the regulated currents, ledge and Ishunt, may be proportional to the two output voltages, edge setting 402 and shunt setting 420, respectively. However, the two outputs, shunt setting 420 and edge setting 402, are independent of one another. Note that the two outputs may be adjusted as necessary to achieve the desired attenuation of the edge LEDs light emissions.

Although a microprocessor 288 is a preferred way of accomplishing the output voltages, the microprocessor 288 is not required. Only the EDGE setting 402 and Shunt setting 420 outputs are needed. Resistive dividers (not shown) may also be used to provide these outputs.

An edge LED control circuit 206 may receive the edge setting output 402. The edge control circuit 206 senses ledge through an edge current feedback signal 95 because of the placement of resistor RE1 231. The circuit then produces an LED voltage 605 at the anode of D1 to maintain the edge current as specified by the edge setting output 402.

A shunt control circuit 306 is utilized to determine the shunt transistor (Q3) control current 131. The shunt control circuit 306 receives the shunt setting output 420. The shunt control circuit 306 also receives a shunt current feedback signal 90 because of the placement of resistor RS1 320. With the shunt current feedback signal 90, the shunt control circuit may then control transistor Q3 base current 131 to maintain the Ishunt specified by the shunt setting 420.

In operation, the LEDs are arranged in a series configuration with a shunt current tap at the node between the center LEDs 63 and the edge LEDs 94. At the electrical node 23 between D3 and D4, a portion of the center LED current is diverted away from the Edge LEDs through transistor Q3 315 and resistor RS1 320 under control of the shunt setting output of the Microprocessor 288 control. The amount of Ishunt depends on the base current reaching transistor Q3 (315). Transistor Q3 315 operates in analog mode to determine the Ishunt current.

Figure 4:
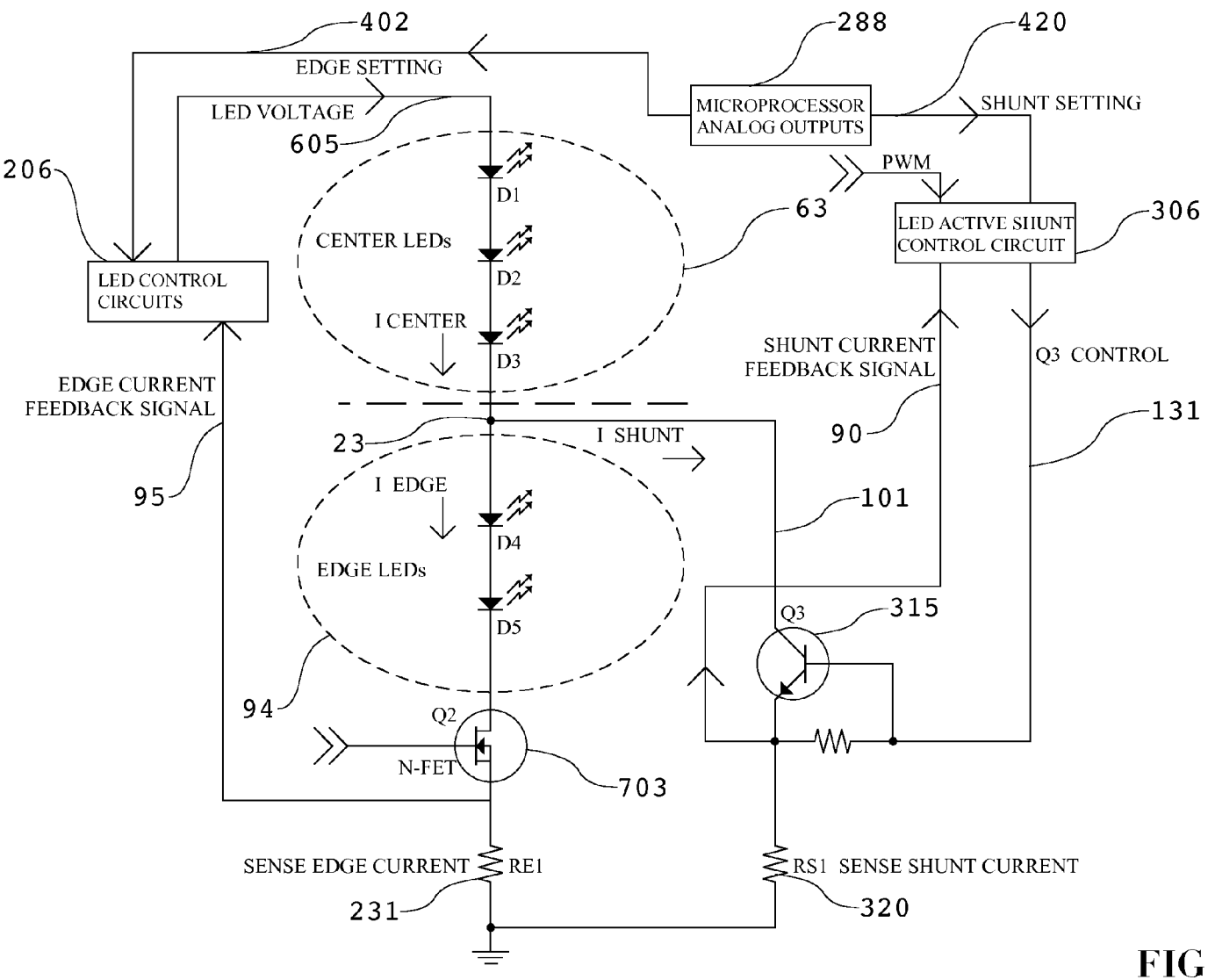
FIG. 4 is a circuit diagram illustrating an embodiment of the shunting process with pulse width modulation included.

FIG. 4 shows a diagram of an embodiment incorporating pulse width modulation (PWM). In this case there are at least three inputs to the LED Active Shunt current control system. As with the last embodiment there is an EDGE setting 402 that sets the edge LED current, ledge, and a shunt setting 420 to set the shunt current, Ishunt. However, in this embodiment, a pulse width modulation is provided. PWM is a common method of LED brightness dimming. PWM dimming is not required for the LED Active shunt operation, but is included here for illustration. In the embodiment diagramed in FIG. 4, there are again two control circuits which operate as previously described in FIG. 3. However, with the addition of pulse width modulation the shunt control circuit 306 may shut off transistor Q3 315 during PWM inactive for dimming purposes. Furthermore, transistor Q2 703 operates in a digital mode to turn off edge LED current during PWM inactive for dimming purposes.

Figure 5:
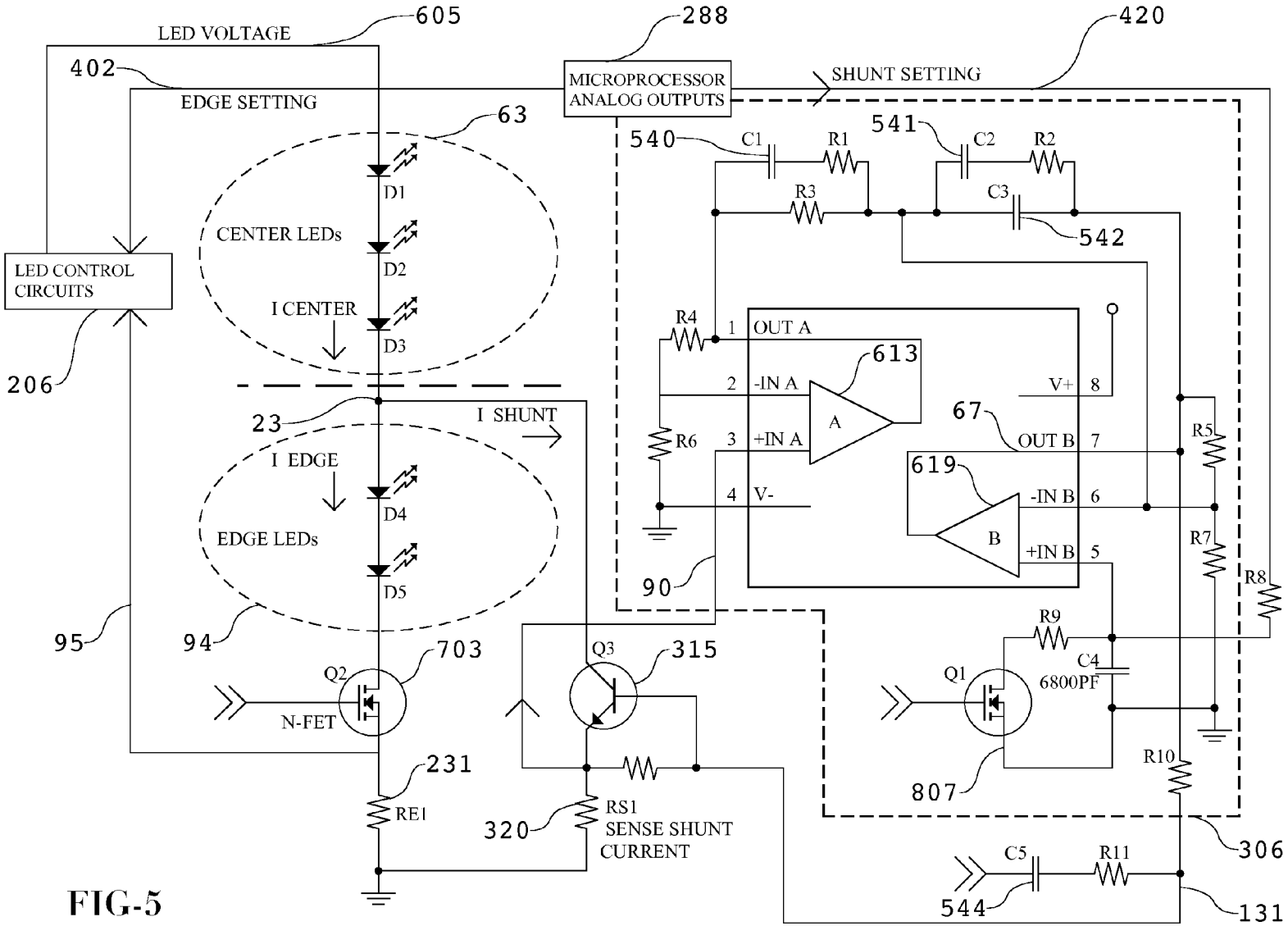
FIG. 5 is a circuit diagram illustrating an embodiment utilizing an exemplary shunt control mechanism that may be employed.

FIG. 5 illustrates another exemplary shunt control circuit 306 to actively shunt current away from the edge LEDs. As with FIG. 4, this embodiment also includes PWM. The LED edge control circuit 206 is a standard circuit that senses LED current at RE1 231. An edge current feedback signal 95 is sent to the edge control circuit 206. The edge control circuit 206 may then modify the LED voltage 605 applied at the anode node of D1. An N-channel field effect transistor (N-FET) Q2 703 provides dimming control via the PWM (pulse width modulation) signal. The edge control circuit 206 sets the edge LED current under control of the "EDGE setting" output 402 of the Microprocessor 288 control.

At the node between D3 and D4 a portion of the Center LED current is again diverted through transistor Q3 315 and resistor RS1 320 under control the "Shunt setting" output 420 of the Microprocessor 288 control. For dimming control, Q1 807 sets the Ishunt to zero during PWM inactive. The Ishunt sensed by RS1 320 is input to operational amplifier "A" 613 with an arbitrary gain. The output OUTA from operational amplifier "A" 613 is used as a feedback input to operational amplifier "B" 619. Operational Amplifier "B" 619 produces a voltage output on OUTB 67 such that the differential input voltage between "−INB" and "+INB" is zero. The voltage output on OUTB then provides the base current for transistor Q3 315. This determines the shunt current, Ishunt. Capacitors C1-540, C2-541, C3-542, and C5-544 modify the AC behavior of the circuit to control loop stability and response time.

Figure 6:
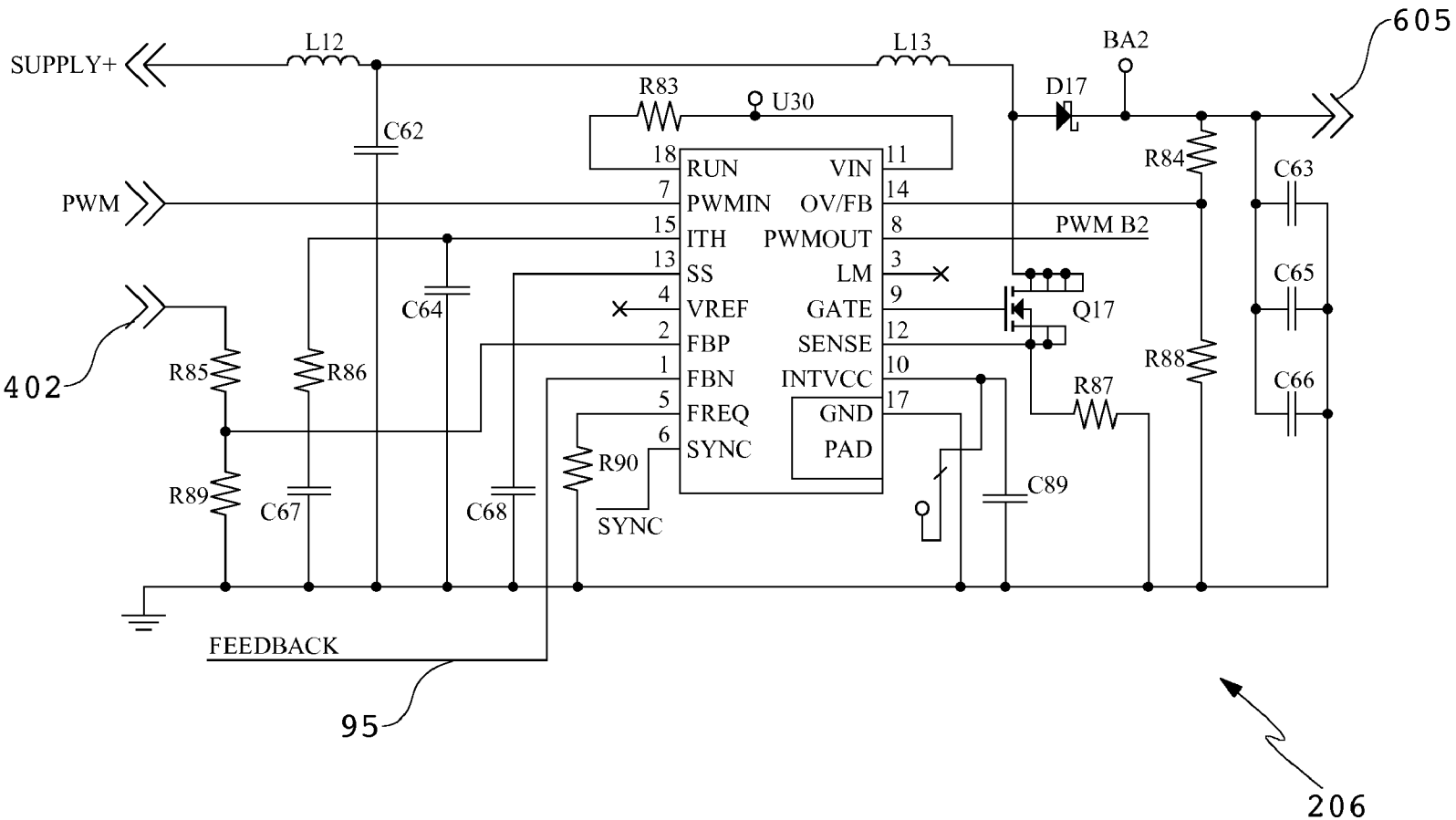
FIG. 6 is an example LED control circuit.

FIG. 6 provides an example LED control circuit which may be used with certain embodiments disclosed herein. As may be appreciated by one skilled in the art, the LED control circuit shown is one of many possible LED control circuits that may be used to determine LED voltage 605. The example shown here is for illustration.

Having shown and described exemplary embodiments of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An LED active shunt current control system for controlling current flow through an LED backlight network of an LCD display, comprising:

a plurality of backlight LEDs connected in series;

wherein edge LEDs are divided from center LEDs in the display backlight by an electrical node;

a shunt tap positioned at the electrical node between the center LEDs and the edge LEDs;

wherein the shunt tap is adapted to divert a predetermined amount of current flowing through the center LEDs away from the edge LEDs;

an analog output generator in electrical communication with an edge control circuit and a shunt control circuit;

wherein the analog output generator is adapted to generate an edge current setting and a shunt current setting;

the edge control circuit is in electrical communication with the plurality of LEDs;

wherein the edge control circuit is adapted to receive the edge setting and provides an LED voltage at an anode of a first center LED to maintain the edge current as specified by the edge setting;

a shunt control circuit in electrical communication with a shunt control transistor; and wherein the shunt control circuit is adapted to receive the shunt setting and provide a voltage to the shunt control transistor to maintain the shunted current as specified by the shunt setting.

2. The system of claim 1, wherein:

the amount of current reaching the edge LEDs is equal to the amount of current flowing through the center LEDs less the amount of current shunted through the shunt tap.

3. The system of claim 1, wherein:

the output generator is a microprocessor.

4. The system of claim 1, further comprising:

an edge current resistor connected downstream of the edge LEDs;

wherein the edge current resistor is adapted to cause an edge current feedback signal to be sent to the edge control circuit.

5. The system of claim 1, further comprising:

a shunt current resistor downstream of the shunt control transistor;

wherein the placement of the shunt current resistor is adapted to cause a shunt current feedback signal to be sent to the shunt control circuit.

6. The system of claim 1, including:

means for dimming the LEDs.

7. An LED active shunt current control system for controlling current flow through an LED backlight network of an LCD display, comprising:

a plurality of backlight LEDs connected in series;

wherein edge LEDs are divided from center LEDs in the display backlight by an electrical node;

a shunt tap positioned at the electrical node between the center LEDs and the edge LEDs;

wherein the shunt tap is adapted to divert a predetermined amount of current flowing through the center LEDs away from the edge LEDs;

an analog output generator;

wherein the analog output generator is adapted to generate an edge current setting and a shunt current setting;

an edge LED control circuit in electrical communication with the plurality of LEDs;

an edge current resistor in electrical communication with the edge control circuit;

wherein the edge current resistor is adapted to cause an edge current feedback signal to be sent to the edge control circuit;

wherein the edge control circuit is adapted to receive both the edge setting and the edge current feedback signal and provide an LED voltage at an anode of a first center LED to maintain an edge current as specified by the edge setting;

a shunt control circuit in electrical communication with a shunt control transistor;

wherein the shunt current resistor is downstream of the shunt control transistor and in electrical communication with the shunt control circuit;

wherein the placement of the shunt current resistor is adapted to cause a shunt current feedback signal to be sent to the shunt control circuit;

wherein the shunt control circuit is adapted to receive the shunt setting output and a shunt current feedback signal; and wherein the shunt control circuit is adapted to produce an output voltage which controls transistor base current to maintain a shunt current specified by the output generator shunt setting.

8. The system of claim 7, wherein:

the output generator is a microprocessor.

9. An LED active shunt current control system for controlling current flow through an LED backlight network, comprising:

a plurality of LEDs connected in series;

wherein edge LEDs are divided from center LEDs in a display backlight by an electrical node;

a shunt tap at the electrical node between the center LEDs and the edge LEDs;

a shunt control transistor in electrical communication with the shunt tap;

an analog output generator;

wherein the analog output generator is adapted to generate an edge current setting and a shunt current setting;

an edge control circuit;

an edge current resistor connected downstream of the edge LEDs;

wherein the edge current resistor is adapted to cause an edge current feedback signal to be sent to the edge control circuit;

wherein the edge control circuit is adapted to receive the edge setting and the edge current feedback signal and provide an LED voltage at an anode of a first center LED to maintain the edge current as specified by the edge setting;

a shunt control circuit in electrical communication with a shunt control transistor;

a shunt current resistor downstream of the shunt control transistor;

wherein the shunt resistor is adapted to cause a shunt current feedback signal to be sent to the shunt control circuit;

wherein the shunt control circuit is adapted to receive the shunt setting and the shunt feedback signal and provides a voltage to the shunt control transistor to maintain a shunted current as specified by the shunt setting;

wherein the shunt control transistor is adapted to operate in an analog mode to facilitate control of the shunt current; and wherein the shunt transistor is adapted to divert a predetermined amount of current away from the edge LEDs through the shunt tap.

10. The system of claim 9, including:

means for dimming the LEDs.

11. A method for achieving color uniformity in an LCD display with an LED backlight array, comprising:

arranging a plurality of backlight LEDs in series;

dividing edge LEDs from center LEDs with an electrical node;

placing a shunt tap at the electrical node;

diverting a predetermined amount of current away from the edge LEDs through the shunt tap in order to attenuate light emitted by the edge LEDs;

providing a shunt control transistor; and engaging the shunt control transistor by directing a predetermined base current to the transistor.

12. The method of claim 11, further including the steps of:

providing a shunt control circuit and a shunt current resistor downstream of the shunt control transistor;

directing a shunt current feedback signal to the shunt control circuit;

providing a voltage to the shunt control transistor to maintain the shunted current as specified by a predetermined shunt setting.

13. The method of claim 12, further including the steps of:

providing an edge control circuit and an edge current resistor in electrical communication with the edge LEDs;

placing the edge current resistor at a location that causes an edge current feedback signal to be sent to the edge control circuit;

receiving an edge setting input and the edge current feedback signal; and generating an LED voltage at an anode of a first center LED to maintain the edge current as specified by the edge setting.

14. The method of claim 13, further including the steps of:

providing an analog output generator in electrical communication with the edge control circuit and the shunt control circuit;

using the output generator to output an edge current setting to set the edge current;

using the output generator to output a shunt current setting to set the shunt base current.

15. The method of claim 14, wherein:

the analog output generator is a microprocessor.

16. The method of claim 11, further including the steps of providing an edge control circuit and an edge current resistor in electrical communication with the edge LEDs;

placing the edge current resistor at a location that causes an edge current feedback signal to be sent to the edge control circuit;

receiving an edge setting input and the edge current feedback signal; and generating an LED voltage at an anode of a first center LED to maintain the edge current as specified by the edge setting.

* * * * *

UNITED STATES PATENT AND TRADEMARK OFFICE

CERTIFICATE OF CORRECTION

PATENT NO. : 7,746,007 B2
APPLICATION NO. : 11/944939
DATED : June 29, 2010
INVENTOR(S) : Robert Cauffield It is certified that error appears in the above-identified patent and that said Letters Patent is hereby corrected as shown below:

On the title page, section (74), Attorney, Agent, or Firm, please delete "Stanley Law Group LLP" and insert --Standley Law Group LLP--

Signed and Sealed this
First Day of March, 2011

David J. Kappos

David J. Kappos
*Director of the United States Patent and Trademark Office*